US006012240A

United States Patent [19]

Klug et al.

[11] Patent Number: 6,012,240

[45] Date of Patent: Jan. 11, 2000

[54] VEHICLE MOUNTABLE SNOWPLOW

[75] Inventors: Steven L. Klug, Milwaukee; Jerald L Plyer, Saukville; Chad T. Barker, Caledonia, all of Wis.

[73] Assignee: Douglas Dynamics, L.L.C., Milwaukee, Wis.

[21] Appl. No.: 08/978,549

[22] Filed: Nov. 26, 1997

[51] Int. Cl.[7] ..... E01H 5/04

[52] U.S. Cl. ..... 37/231; 172/272; 172/817

[58] Field of Search ..... 172/272, 273, 172/274, 275, 311, 456, 817; 280/416.2, 479.1; 37/231, 234, 236, 235; 414/723; 403/322.3

[56] References Cited

U.S. PATENT DOCUMENTS

| | | | |
|---|---|---|---|
| 2,577,145 | 12/1951 | Nearing et al. | 280/33.15 |
| 2,667,708 | 2/1954 | Gjesdahl | 37/42 |
| 2,710,464 | 6/1955 | Husting | 37/42 |
| 2,793,880 | 5/1957 | Oehler et al. | 280/477 |
| 3,410,008 | 11/1968 | Standfuss | 37/42 |
| 3,512,804 | 5/1970 | Siegert | 280/509 |
| 3,851,894 | 12/1974 | St. Pierre | 172/275 X |
| 3,964,622 | 6/1976 | Blair et al. | 214/145 A |
| 3,987,562 | 10/1976 | Deen et al. | 37/42 R |
| 4,030,624 | 6/1977 | Matthews | 172/272 X |
| 4,119,225 | 10/1978 | Macht et al. | 172/273 X |
| 4,554,978 | 11/1985 | Schneider | 172/247 |
| 4,962,599 | 10/1990 | Harris | 37/266 |
| 5,014,452 | 5/1991 | Berghefer | 37/235 |
| 5,027,536 | 7/1991 | Farrell | 37/236 |
| 5,067,742 | 11/1991 | Relja | 280/479 |
| 5,082,065 | 1/1992 | Fletcher | 172/273 |
| 5,193,296 | 3/1993 | Reilley | 37/231 |
| 5,205,058 | 4/1993 | Allen et al. | 37/231 |
| 5,353,530 | 10/1994 | Pieper | 37/231 |
| 5,392,541 | 2/1995 | O'Riordan | 37/468 |
| 5,403,144 | 4/1995 | Staben, Jr. | 414/723 X |
| 5,485,690 | 1/1996 | MacQueen | 37/271 |
| 5,568,694 | 10/1996 | Capra et al. | 37/231 |
| 5,570,897 | 11/1996 | Wass | 280/495 |
| 5,615,745 | 4/1997 | Cross | 172/811 |
| 5,647,153 | 7/1997 | Gervais | 37/231 |
| 5,685,689 | 11/1997 | Schreider et al. | 414/723 X |
| 5,692,855 | 12/1997 | Burton | 172/272 X |

OTHER PUBLICATIONS

Brochure, Hiniker Plows—The Hottest Thing in Snow Control—Quick Hitch Mounting System; Hiniker Company, Mankato, Minnesota, Apr. 1996.

Brochure, The Boss—Straight Blade Snowplow; M. J. Electric, Inc., Iron Mountain, Michigan 1990.

Brochure, Jensen Snowplows—The new Jensen Quik Hitch, (no date).

Brochure, Diamond Snowplows; Diamond Equipment, Auburn, Maine, (no date).

Brochure, Diamond Snowplows—It's a Better Plow . . . It's That Simple!; Diamond Equipment, Auburn, Maine, (no date).

Installation instructions, Diamond Easy–Hitch; Diamond Equipment, Auburn, Maine, (no date).

Brochure, Diamond Snowplows by Meyer; Diamond Equipment, Damariscotta, Maine, Sep. 1996.

Installaton Instructions, Ford F250; Fisher Engineering, Rockland, Maine, Sep. 1993.

*Primary Examiner*—Robert E. Pezzuto

*Attorney, Agent, or Firm*—Michael Best & Friedrich LLP

[57] ABSTRACT

A snowplow for selective attachment to a vehicle, comprising a frame, a blade attached to the frame, and a latching mechanism that is movable to first and second positions to allow selective engagement or disengagement of the snowplow with the vehicle. The latching mechanism is operable by a user from a location point remote from underneath the vehicle.

54 Claims, 9 Drawing Sheets

VEHICLE MOUNTABLE SNOWPLOW

FIELD OF THE INVENTION

The invention relates to snowplow assemblies, and more particularly, to snowplow assemblies that are removably mounted to a vehicle.

BACKGROUND OF THE INVENTION

Snowplows that are mounted to vehicles such as automobiles and light trucks are customarily attached to the vehicle frame. Most often the vehicle frame is only accessible from underneath the vehicle and it is often necessary to reach under the vehicle in order to attach the snowplow to the frame. Typically, a bracket is fixedly attached to the vehicle frame and the snowplow is attached to the bracket with one or more fasteners.

Many arrangements have been devised using fasteners and brackets in order to facilitate connection of the snowplow to the vehicle. Many such devices inconvenience the user by requiring the user to reach underneath the vehicle in order to connect or disconnect the snowplow from the vehicle. This is especially inconvenient during the winter, and in the snowy or dirty conditions in which the snowplow is ordinarily used.

SUMMARY OF THE INVENTION

The present invention is a vehicle mountable snowplow that can be removably attached to a vehicle in a relatively quick and convenient fashion. The snowplow can be connected to and disconnected from the vehicle without having the user reach underneath the vehicle. The snowplow is not only easily attached to and detached from the vehicle, the snowplow is also stable and secure during use.

Specifically, the present invention provides a snowplow for selective attachment to a vehicle. The snowplow includes a plow frame, a blade attached to the plow frame, and at least one latching mechanism on the plow frame. The latching mechanism is movable to a first position wherein the plow frame is engaged with the vehicle, and is also movable from the first position to a second position wherein the plow frame is disengaged from the vehicle.

The latching mechanism includes a hitch member that is movable with respect to the plow mount. The hitch member has thereon a hitch pin. When the latching mechanism is in it first position, the hitch pin interengages with the vehicle. Preferably, the hitch member includes a first arm, a second arm secured to the first arm, and a third arm secured to the second arm, wherein the second arm is movably secured to the frame.

The invention further provides a lock to maintain the latching mechanism in its first position. The lock includes a locking pin on the plow frame.

Such a snowplow provides the feature of a latching mechanism that is actuated by the user to engage and disengage the snowplow from the vehicle at a point remote from the vehicle. The hitch member extends beyond the vehicle, thereby allowing remote operation of the latching mechanism. In this way, the snowplow can be selectively attached and detached from the vehicle using a simple and convenient motion.

It is an object of the present invention to provide a new and improved vehicle mountable snowplow assembly.

It is another object of the present invention to provide a snowplow assembly that may be quickly and simply connected and disconnected from a vehicle.

It is another object of the present invention to provide a snowplow assembly that includes a hitch member that extends beyond the vehicle, and is movable from a point remote from the vehicle.

It is another object of the present invention to provide a locking mechanism to maintain the snowplow in its engaged or disengaged position relative to the vehicle.

It is another object of the present invention to provide a hitch member having a first arm, a second arm, and a third arm, wherein the second arm is pivotally secured to the frame of the snowplow, and the first arm extends beyond the vehicle.

It is another object of the present invention to provide an apparatus that selectively secures a snowplow to a vehicle, and includes a vehicle mount and a plow mount.

Other features and advantages of the invention will become apparent to those of ordinary skill in the art upon review of the following detailed description, claims, and drawings.

DETAILED DESCRIPTION OF THE PREFERRED EMBODIMENT

Figure 1:
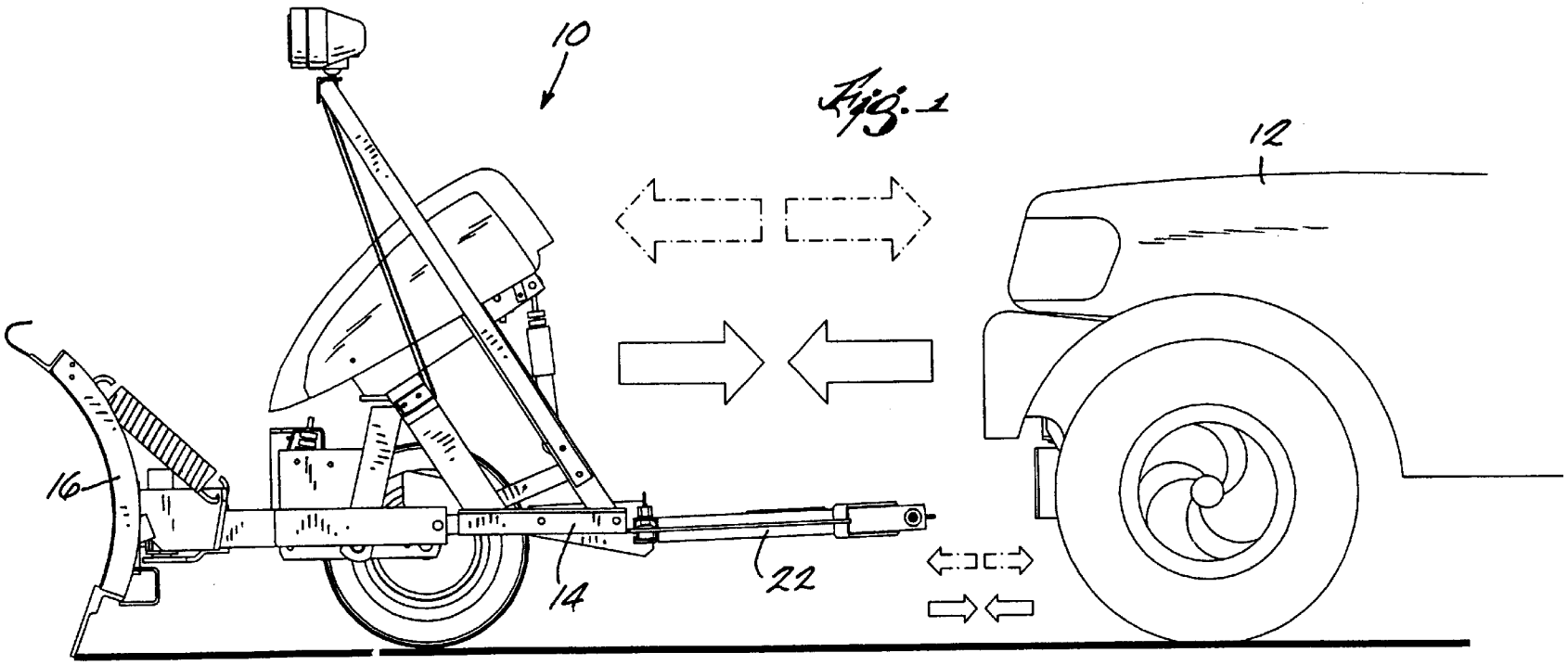
FIG. 1 is a side view of a vehicle mountable snowplow assembly in position for mounting to a vehicle mount of a vehicle.

Referring to the drawings, FIG. 1 shows a snowplow assembly 10 according to the present invention. As indicated by the arrows, the snowplow assembly 10 may be moved into position such that it may be selectively attached or connected to a vehicle 12 (solid arrows) and may subsequently be detached or disconnected from the vehicle 12 (broken arrows). Snowplow assembly 10 can be any type of vehicle mountable snowplow such as the snowplow illustrated and described in U.S. application Ser. No. 08/938,004, filed Sep. 12, 1997, entitled "Vehicle Mounted Accessory Assembly" and herein incorporated by reference.

Figure 2:
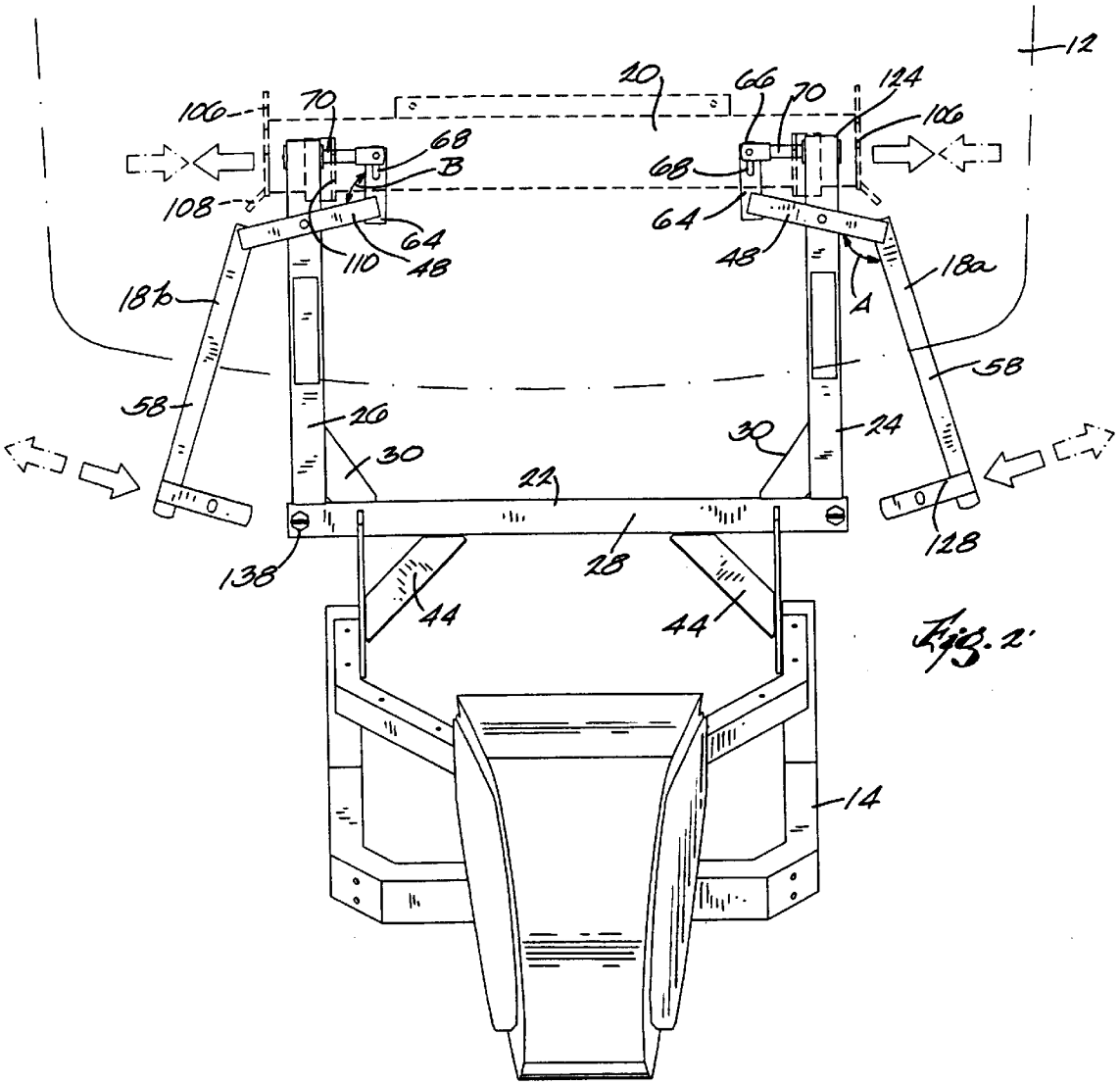
FIG. 2 is a top view of a portion of the snowplow assembly and a portion of the vehicle.

As illustrated in FIG. 1, the snowplow assembly 10 generally includes a frame 14 and a blade 16 attached to the forward end of the frame 14. The snowplow assembly 10 also includes a pair of hitch assemblies or latching mechanisms 18*a* and 18*b* (hereafter collectively 18) as shown in FIG. 2. The latching mechanisms 18 enable the connection to and disconnection of the snowplow assembly 10 from the vehicle 12. The latching mechanisms 18 interconnect the snowplow assembly 10 to the vehicle 12 and, specifically, to a mount member or vehicle mount 20 fixed to the vehicle 12.

Referring now to FIGS. 1 and 2, preferably the latching mechanisms 18 are mounted to an intermediate member or plow mount 22 and the plow mount 22 in turn is secured to the frame 14. It should be noted, however, that the latching mechanisms 18 can also be mounted directly to the frame 14 without the use of the plow mount 22.

As best shown in FIG. 2, the plow mount 22 includes a pair of generally parallel spaced mount arms 24 and 26 that are connected by a mount brace 28 so that the plow mount 22 is generally U-shaped. The mount arms 24 and 26 are fixedly secured to the mount brace 28 such as by welding. A gusset brace 30 is positioned and secured in each of the intersections of the mount arms 24 and 26 to the mount brace 28 to add structural support to the plow mount 22.

Figure 4:
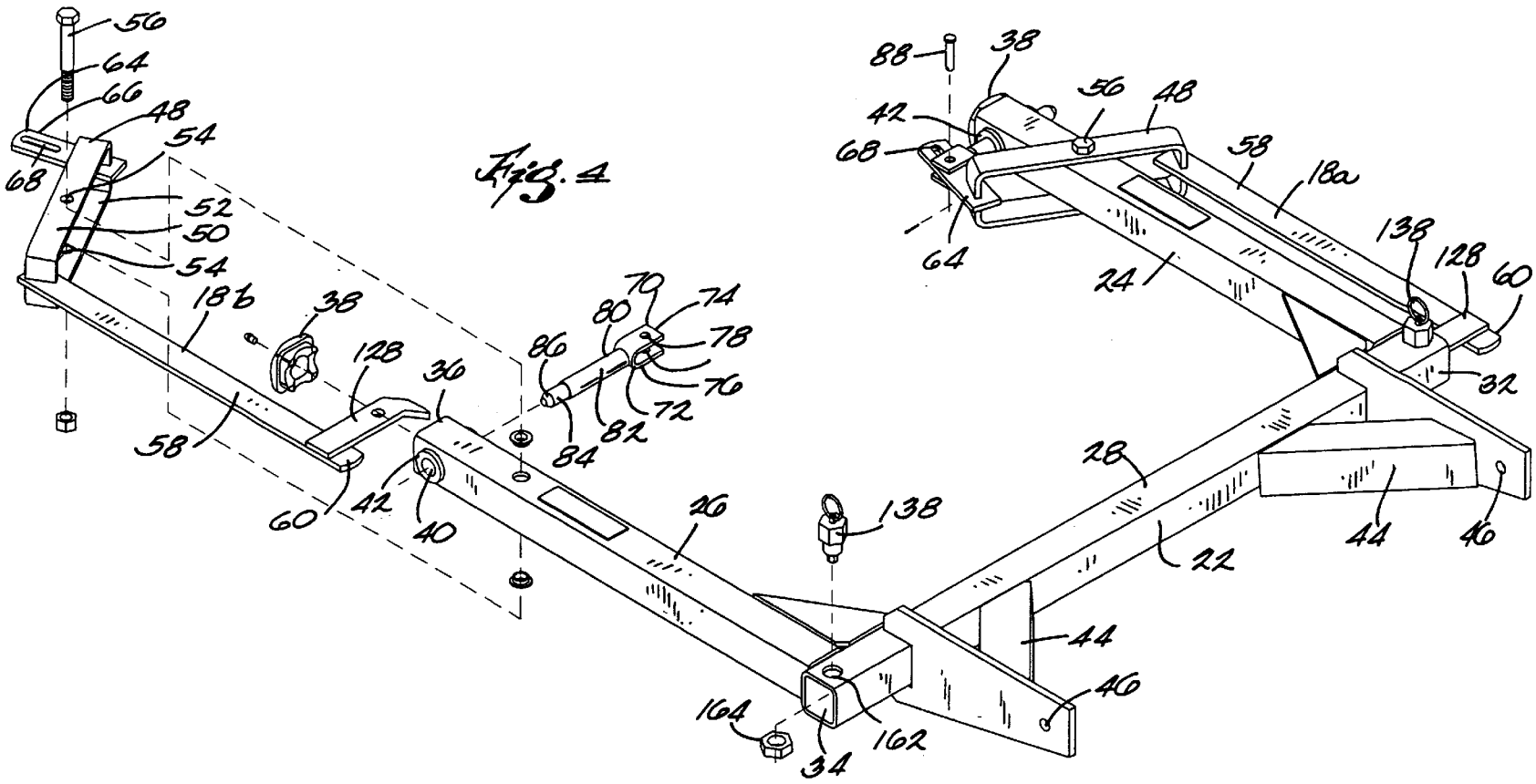
FIG. 4 is perspective view, partially exploded, of the latching mechanism mounted on the plow mount.

As best shown in FIG. 4, preferably the mount arms 24 and 26 and the mount brace 28 are hollow metal tubes that are square in cross-section and have an interior. The mount brace 28 includes a recess such as hollow end 32 and hollow end 34. Each mount arm 24 and 26 has a hollow end 36. A cap 38 is positioned in the hollow end 36 of each of the mount arms 24 and 26. Each cap 38 serves as a protective covering for a grease fitting and serves as an anti-friction surface during connection of the plow mount 22 to the vehicle 12.

Continuing to refer to FIG. 4, a bushing 42 is mounted in each mount arm 24 and 26. Preferably, the bushing 42 is fixed in the respective mount arm 24 or 26 such as by welding. Each bushing 42 defines a cylindrical passageway or bore 40 therethrough. For example, the bore 40 has a diameter D1 that is 0.75 inches.

A pair of mounting brackets 44 extend perpendicularly outwardly from the mounting brace 28 in a direction away from the mount arms 24 and 26. Each mounting bracket 44 is fixedly secured to the mounting brace 28 such as by welding. Each bracket 44 has therein an aperture 46. As shown in FIGS. 1 and 2, the plow mount 22 is secured to the frame 14 with the mounting brackets 44. When the plow mount 22 is aligned with the frame 14, a fastener, such as a bolt, can be positioned in the aperture 46 of each of the brackets 44 to secure the plow mount 22 to the frame 14. Preferably, at assembly, a second aperture is drilled in each bracket 44 and an aligned aperture is drilled in the frame 14 with a fastener being positioned in the aligned apertures. This second connection of the brackets 44 to the frame 14 prevents rotation of the plow mount 22.

Referring back to FIG. 2, preferably, the snowplow assembly 10 includes a latching mechanism 18*a* in operational engagement with the mount arm 24 and a latching mechanism 18*b* in operational engagement with the mount arm 26. The latching mechanisms 18*a* and 18*b* are preferably operationally identical and mirror images of each other. Hereafter, only one latching mechanism 18*a* in relation to mount arm 24 will be described.

Figure 3:
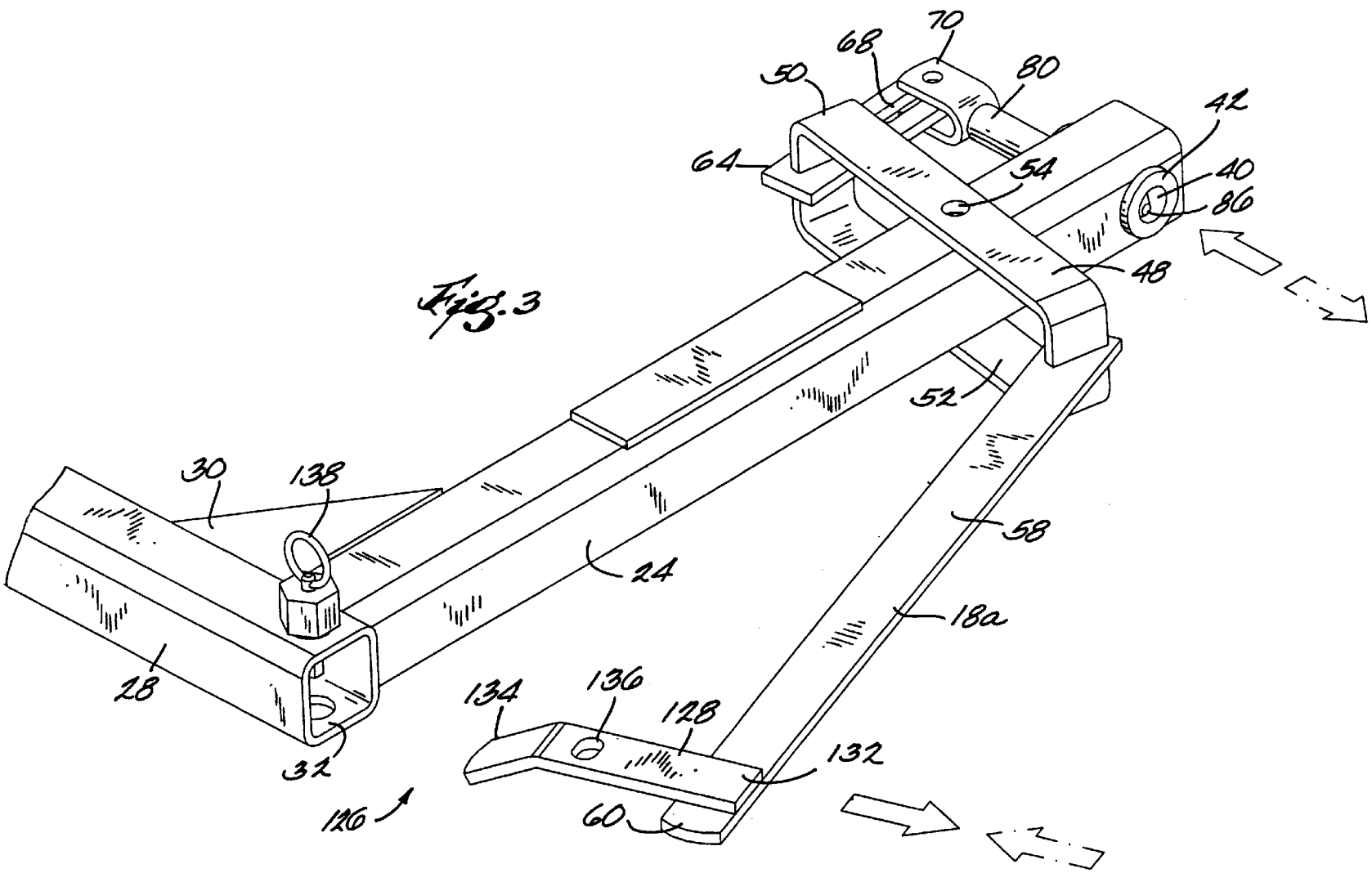
FIG. 3 is a perspective view of a latching mechanism mounted on the plow mount.

As best shown in FIGS. 3 and 4, the latching mechanism 18*a* includes link arm 48. The link arm 48 is comprised of a first portion 50 and a second portion 52 that are generally C-shaped and are oriented to surround the mount arm 24. The first and second portions 50 and 52 respectively each have therethrough an aperture 54 that is axially aligned. The link arm 48 is pivotally secured to mount arm 24 with a pivot pin 56 that is positioned and secured in each of the apertures 54.

A hitch arm 58 extends outwardly from the link arm 48 and, specifically, extends outwardly from one of the intersections of the first portion 50 and the second portion 52. The hitch arm 58 is secured in this orientation such as by welding. The hitch arm 58 forms an angle A (FIG. 2) of preferably approximately 120 degrees with respect to the link arm 48. The hitch arm 58 terminates in an end 60. The hitch arm 58 is elongate and preferably has a length that is approximately equal to the distance between the link arm 48 and the mount brace 28.

Continuing to refer to FIGS. 3 and 4, a link arm 64 extends outwardly from the link arm 48 and specifically, extends outwardly from the other of the intersections of the first portion 50 and the second portion 52. The link arm 64 is secured in this orientation such as by welding. The link arm 64 forms an angle B (FIG. 2) of preferably approximately 120 degrees with respect to the link arm 48. The link arm 64 terminates in an end 66. The link arm 64 includes an elongate slot 68 adjacent the end 66. The link arm 64 preferably has a length that is approximately equal to the distance between the link arm 48 and the bore 40 in the mount arm 24.

Preferably, the link arms 48, 58 and 64 are interconnected to form a hitch member that pivots about mount arm 64.

As best shown in FIG. 4, a pin assembly 70 is in operation engagement with the link arm 64. The pin assembly 70 includes a mounting clevis 72 which includes a first leg 74 and a second leg 76. Each leg 74 and 76 has therethrough an axially aligned aperture 78. The clevis 72 is fixedly secured to a hitch pin 80. The pin 80 can having any number of cross-sectional configurations including, for example, cylindrical, triangular, square, rectangular, hexagonal or the like. The pin 80 is preferably stepped and includes a first portion 82 having a cross-section or diameter D2 and a second portion 84 having a cross-section or diameter D3. The pin 80 terminates in a tapered tip 86. D3 is preferably smaller than D2. For example, D2 is 0.735 inches and D3 is 0.625 inches.

With reference to FIG. 4, the pin assembly 70 is movably secured to the link arm 64 with a fastener such as a pin 88. To assemble the pin assembly 70 about the link arm 64, the link arm 64 is placed between the legs 74 and 76 of the clevis 72 such that the apertures 78 of the legs 74 and 76 and the slot 68 of the link arm 68 are axially aligned. The pin 88 is then positioned in the axially aligned apertures 78 and slot 68 and maintained in this orientation such as with a cotter pin.

In this orientation, the pin 88 is slidable along the length of the slot 68. When the pin assembly 70 is so oriented, the hitch pin 80 is housed and moveable within the bore 40. Movement of the hitch arm 58 moves the pin 80 within the bore 40. Having the pin 80 remain contained yet moveable within the bore 40 prevents the pin 80 from getting lost or misaligned. This orientation also requires less pin movement to secure the snowplow assembly 10 to the vehicle 12.

Figure 7:
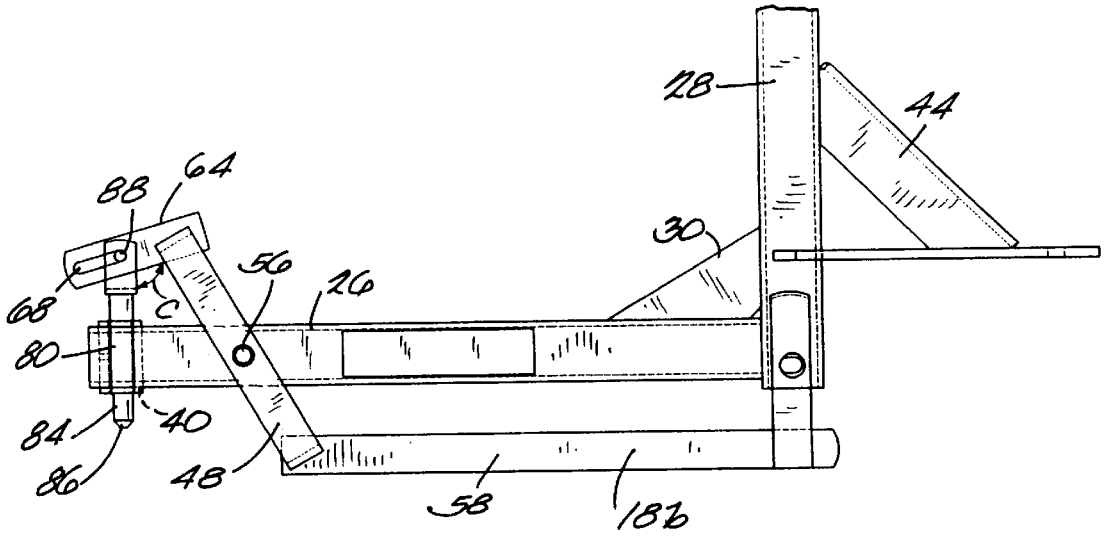
FIG. 7 is a top view of the latching mechanism in its engaged or first position.
Figure 8:
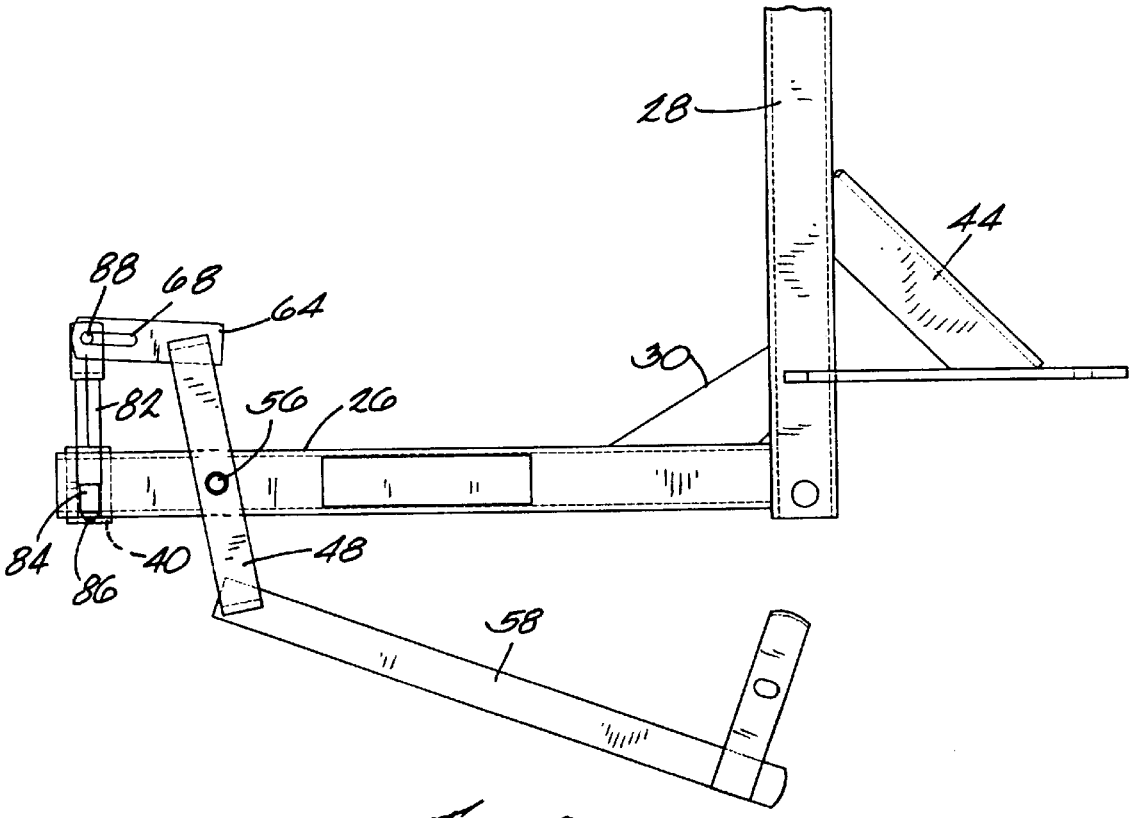
FIG. 8 is a top view of the latching mechanism in its disengaged or second position.

Turning now to FIGS. 7 and 8, both latching mechanisms 18*a* and 18*b* are moveable between a first or engaged position as shown in FIG. 7 and a second or disengaged position as shown in FIG. 8.

With specific reference to FIG. 7 and latching mechanism 18*b*, when the latching mechanism 18*b* is in its first or engaged position: (i) the tip 86 and the second portion 84 of the pin 80 extend outwardly from the bore 40 of the mount arm 26; (ii) the hitch arm 58 is adjacent to and approximately parallel to the mount arm 26; and (iii) the pin 88 is at the end of the slot 68 adjacent the link arm 48 such that the link arm 64 forms an angle C of approximately 106 degrees with the longitudinal axis of the pin 80.

With specific reference now to FIG. 8, when the latching mechanism 18 is in its second or disengaged position: (i) the tip 86 and the second portion 84 of the pin 80 are housed within the bore 40 and do not extend outwardly from the mount arm 26; (ii) the hitch arm 58 is no longer parallel to the mount arm 26; and (iii) the pin 88 is at the other end of the slot 68 adjacent the pin 80 such that the link arm 64 is approximately perpendicular to the longitudinal axis of the pin 80.

The use of the pin 88 and slot 68 arrangement enables easier translation of the movement of the hitch arm 58 to the pin 80 within the bore 40. Designing the hitch arm 64 orientation such that the hitch arm 64 is generally perpendicular to the pin 80 when the latching mechanism 18 is in its disengaged position, and such that the hitch arm 64 is at an angle with respect to the pin 80 when the latching mechanism 18 is in its engaged position, further enables easier translation of the movement of the hitch arm 58 to the pin 80 within the bore 40. Specifically, movement of the hitch arm 58 toward the respective mount arm 26 causes the link arm 64 to apply a force to pin 80, with that force being in line with the longitudinal axis of the pin 80 thereby enabling the translation of a more fluid motion of the pin 80 within the bore 40.

Figure 5:
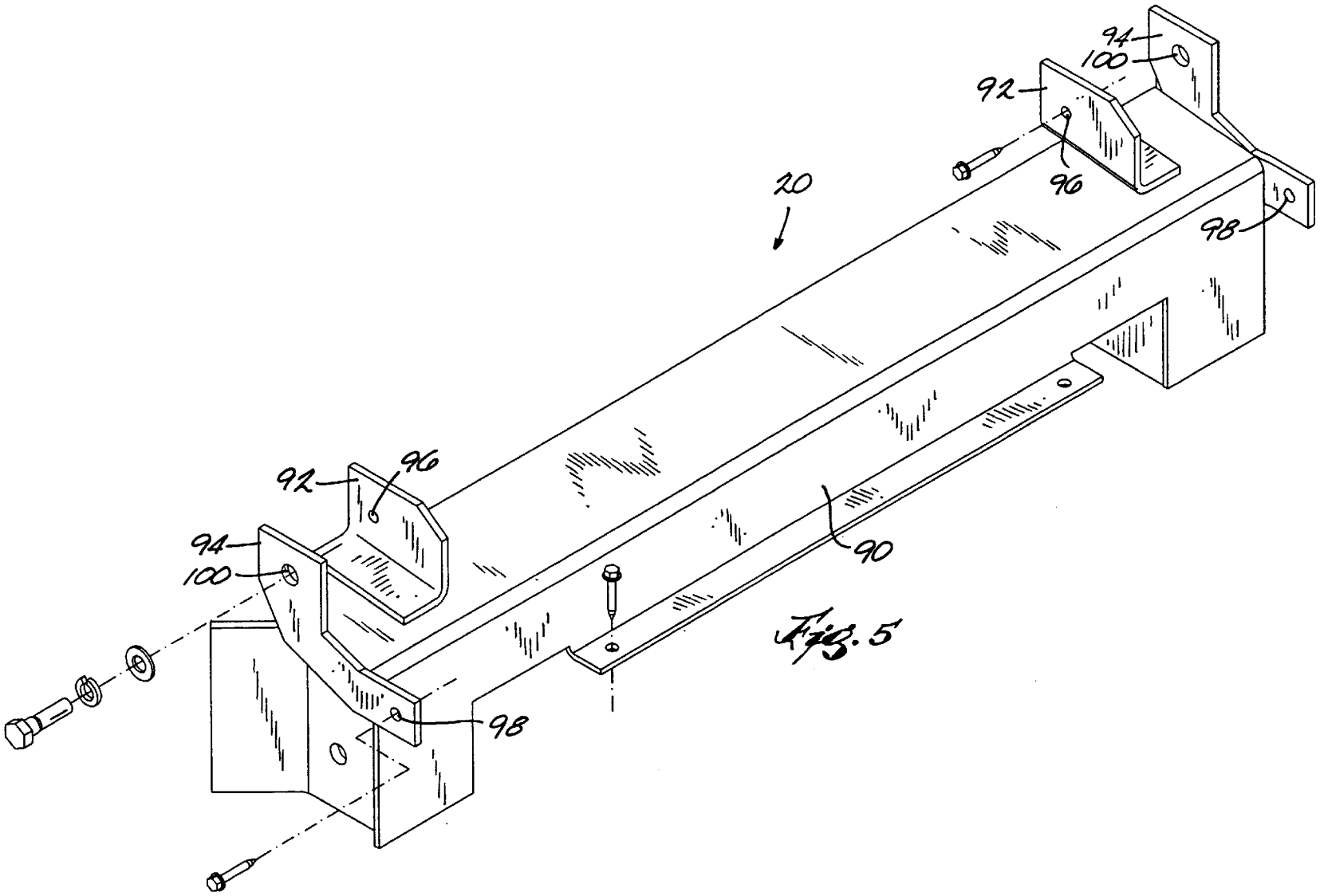
FIG. 5 is a perspective view of the vehicle mount.
Figure 6:
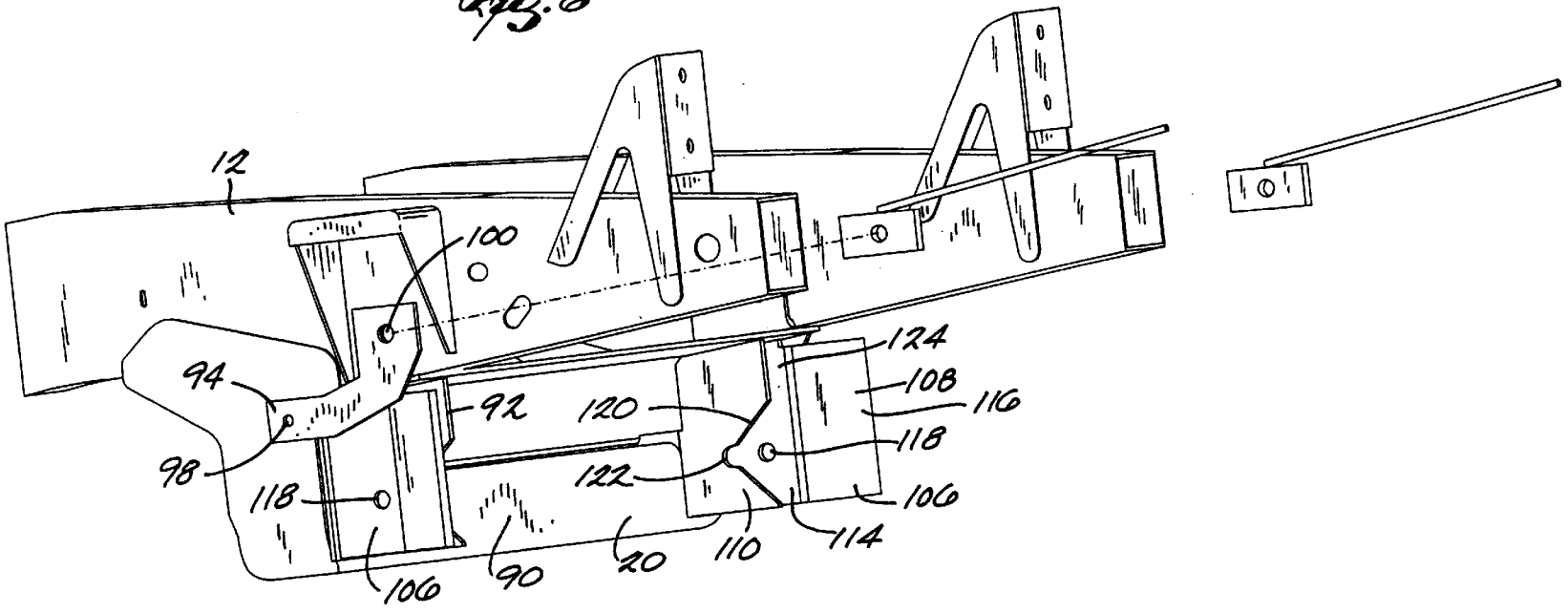
FIG. 6 is a perspective view of the vehicle mount fixed to a portion of the vehicle.

Turning now to FIGS. 5 and 6, the vehicle mount 20 is illustrated. The vehicle mount 20 includes an elongate body 90, a pair of vehicle mounting brackets 92 and a pair of vehicle mounting brackets 94. One bracket 92 and one bracket 94 are adjacent each end of the body 90. The bracket 92 has therein an aperture 96. The bracket 94 is generally L-shaped and has therein apertures 98 and 100.

As shown in FIG. 6, the vehicle mount 20 is secured to the vehicle 12, and preferably to the frame of the vehicle 12, using the pairs of vehicle mounting brackets 94 and 96. Specifically, the aperture 100 is aligned with a preexisting or drilled aperture in the vehicle frame and a suitable fastener is positioned therethrough. With respect to apertures 96 and 98, they are preferably drilled at assembly to be aligned with apertures in the vehicle frame which are also preferably drilled at assembly. Fasteners are thereafter positioned in the apertures 96 and 98 and the respective apertures in the vehicle frame to maintain the orientation of the vehicle mount 20 to the vehicle 12.

It should be noted that vehicle mount 20 can have varying configurations to be suitable for attachment to different vehicles. Further, how the vehicle mount 20 is attached to the vehicle can also vary depending upon the type of vehicle to which the mount 20 is to be attached.

With respect to where the vehicle mount 20 is located, preferably, the mount 20 is positioned near the front axle of the vehicle 12 so as to be a distance from the vehicle bumper under the vehicle 12. Having the vehicle mount 20 so positioned enhances the aesthetics of the vehicle 12 because the vehicle mount 20 cannot be seen at normal eye level. Further, this positioning of the vehicle mount 20 also improves the crash worthiness of the vehicle 12.

With the use of the plow mount 22 separating the frame 14 from the vehicle 12, the vehicle bumper does not limit the range of motion of the snowplow blade 16. Further, with the use of the plow mount 22, less stresses are transferred to the vehicle 12. The orientation of the vehicle mount 20, the plow mount 22 and the frame 14 as shown in FIG. 1 eliminates any downward forces the snowplow would exert on the vehicle 12 and instead exerts a slight upward force to the vehicle 12.

As best shown in FIGS. 2 and 6, the vehicle mount 20 further includes a pair of spaced locking assemblies 106. The locking assemblies 106 are spaced from one another approximately the distance that the mount arms 24 and 26 are spaced from one another. Each locking assembly 106 includes a plate 108 and a plate 110. The plate 108 includes a first portion 114 and a second portion 116, with the second portion 116 being flared at an angle of preferably 45 degrees with respect to the first portion 114. The first portion 114 has therethrough an aperture 118. The first portion 114 is generally parallel to the plate 110.

The plate 110 has therein a generally V-shaped recess 120 that terminates in a semi-circular recess 122. The recess 122 is axially aligned with the aperture 118 in the plate 108. The plates 108 and 110 define therebetween a locking channel 124.

The snowplow assembly 10 is connected to and released from the vehicle 12 as follows. With reference to FIG. 1, the snowplow assembly 10 is positioned adjacent the vehicle 12 and vehicle mount 20 such that the mount arms 24 and 26 are generally aligned with their respective locking channel 124. The snowplow assembly 10 is moved further in the direction of the vehicle 12 until the first portion 82 of the hitch pin 80 is positioned in the recess 122 and contacts the plate 110 as shown in FIG. 2. As the mount arm 24 enters the locking channel 124, the mount arm 24 with pin assembly 70 extending outwardly is able to continue to move forwardly because of the recesses 120 and 122.

The locking assemblies 106 are designed such that if the mount arms 24 and 26 are not perfectly aligned as they move toward the locking channels 124, the second flared portion 116 acts to guide the respective mount arm 24 or 26 into the locking channel 124. The cap 38 having a smooth outer surface also aids in sliding the mount arms 24 and 26 into a respective locking channel 124.

Referring now to FIG. 2, the latching mechanism 18 on each of the mount arms 24 and 26 is then actuated as follows. The pins 80 of each latching mechanism **18*a* and 18*b* are already axially aligned with the respective aperture 118 in the plate 108. This orientation is enabled due to the recesses 120 and 122 in the plate 110. With respect to mount arm 24 and latching mechanism 18*a*, the hitch arm 58 is moved toward the mount arm 24 as illustrated by the solid arrow. Movement of the hitch member 58 pivots the link arm 48 about the pivot pin 56 which in turn moves the pin 80 toward the plate 108 as illustrated by another solid arrow in FIG. 2. The pin 80 moves within the bore 92 of the mount arm 24 such that the second portion 84 of the pin 80 enters and is housed in the aperture 118 of the plate 108. When the pin 80 is housed in aperture 118, the latching mechanism 18*a* is in its first or engaged position such that the snowplow assembly 10 is secured to the vehicle 12**.

Latching mechanism **18*b* is similarly actuated from its second or disengaged position to its first or engaged position with respect to mount arm 26**.

To maintain the latching mechanisms **18*a* and 18*b* in their engaged positions, many types of releasable fasteners can be employed, such as removably securing both hitch arms 58 to the respective mount arm 24 or 26**. However, preferably a locking mechanism is employed.

With reference to FIG. 3, a locking mechanism 126 for each latching mechanism **18*a* and 18*b* is shown. The locking mechanisms 126 are preferably identical and mirror images of each other. Accordingly, only the locking mechanism 126 used in conjunction with latching mechanism 18*a*** with be hereafter described.

The locking mechanism 126 includes a link arm 128 extending generally perpendicularly outwardly from the hitch arm 58 in a direction toward the mount arm 24. The link arm 128 is secured to the hitch arm 58 such as by welding. The link arm 128 includes a first portion 132 and a second ramp portion 134. The first portion 132 has therein an aperture 136. The ramp portion 134 is angled downwardly with respect to the first portion 132 by an angle of preferably 30 degrees. The link arm 128 is positioned relative to the hitch arm 58 such that movement of the hitch arm 58 toward the mount arm 24 moves the link arm 128 into the interior of the mount brace 28 via the hollow end 32. The link arm 128 is releasably held within the mount brace 28 by a locking pin 138.

Figure 9:
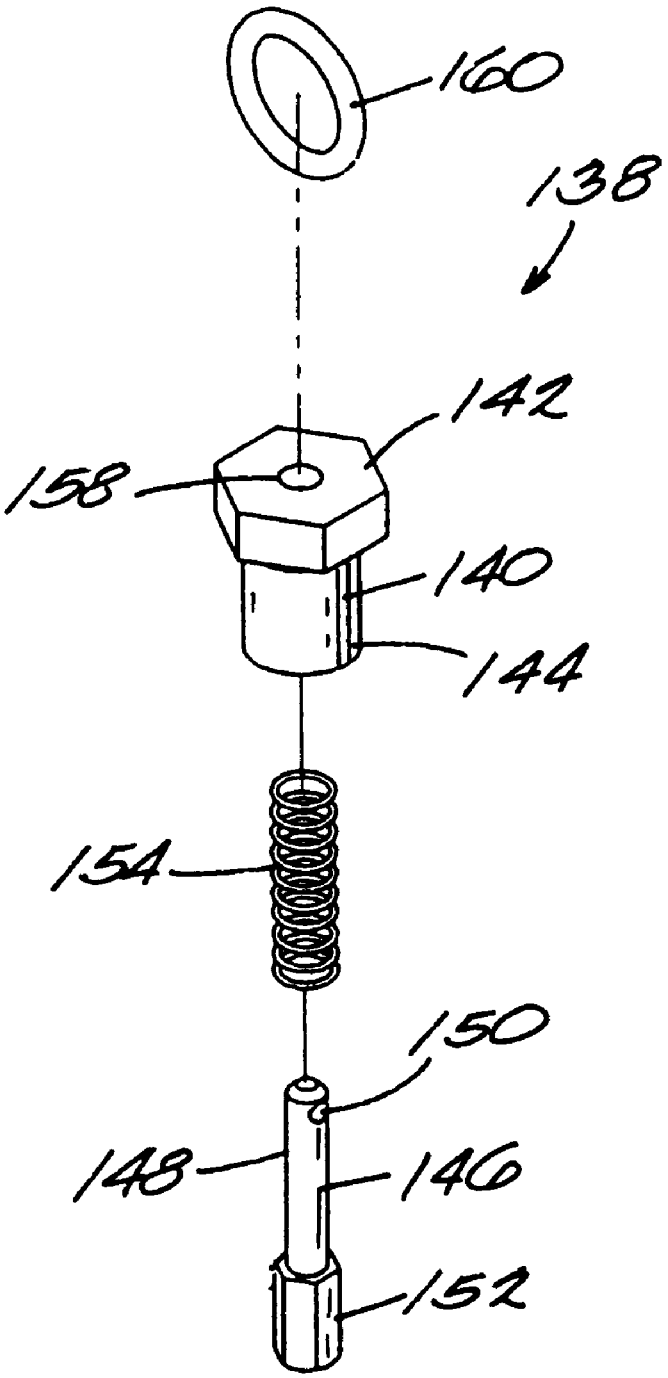
FIG. 9 is an exploded perspective view of a locking pin.

Turning now to FIG. 9, the locking pin 138 is illustrated. The locking pin 138 includes a lock body 140 having a hexagonal shaped cap 142 and a hollow cylindrical portion 144. A plunger 146 is housed within the cylindrical portion 144. The plunger 146 includes a shaft 148 having therethrough a bore 150. The shaft 148 terminates at one end in a hexagonal cap 152. A spring 154 surrounds the shaft 148 and is likewise housed within the cylindrical portion 144. The plunger 146 and spring 154 are housed in the cylindrical portion 144 such that the end of the shaft 148 having the bore 150 therethrough is moveable through an aperture 158 within the cap 142 of the lock body 140.

With the aperture 150 extending outwardly from the cap 142 through the aperture 158, a split ring 160 is positioned within the bore 150 of the shaft 148. Movement of the split ring 160 away from the cap 142 by a user overcomes the bias of the spring 154 and moves the plunger 146 upwardly into the cylindrical portion 144. When the user releases the split ring 160, the bias of the spring 154 returns the plunger 146 to its normal portion, that being extending outwardly from the cylindrical portion 144.

With reference to FIG. 4, each locking pin 138 is mounted in a respective aperture 162 in the mounting brace 28 such that the cylindrical portion 144 extends into the interior of the mount brace 28 and the cap 142 abuts the top surface of the mount brace 28. The locking pin 138 is held in this orientation through use of a fastener such as nut 164.

To secure the latching mechanism 18*a* in its first or engaged position, the hitch arm 58 is swung so that the link arm 128 begins to move into the interior of the mount brace 28 at the end 32. Further movement of the link arm 128 forces the plunger 146 upwardly due to the plunger 146 abutting the ramp portion 134 of the link arm 128 and overcoming the force of the spring 154. Continued movement of the link arm 168 into the interior of the mount brace 28 will eventually cause the plunger 146 to move downwardly via spring 154 action when the plunger 146 is aligned with aperture 136 in the link arm 168. With the plunger 146 in the aperture 136, the hitch arm 58 is held in place. The ramp portion 134 serves to automatically actuate the locking pin 138 without the user having to manually pull up on the split ring 160 of the locking pin 138. The movement of the link arm 128 into the interior of the mount brace 28 by the user automatically actuates the locking pin 138 to hold the latching mechanism 18*a* in its engaged position.

In addition to the ramp portion 134 aiding the alignment and actuation of the plunger 146 in the aperture 136, the ramp portion 134 also serves to prevent the plunger 146 from becoming inadvertently dislodged from the aperture 136. Specifically, the ramp portion 134 serves to minimize the range of movement of the link arm 128 in the mount brace 28. If a downward force is applied to link arm 128, before the link arm 128 can move downwardly enough to free the plunger 146 from the aperture 136, the ramp portion 134 will abut the bottom surface of the interior.

It should be noted that movement of the hitch arm 58 actuates both the latching action of the pin 80 as well as the locking action of locking pin 138.

To release or disengage the snowplow assembly 10 from the vehicle 12, the split ring 160 of the locking pin 138 is moved upwardly by the user thus freeing the plunger 146 from the aperture 136. The hitch arm 58 associated with each mount arm 24 and 26 can then be moved outwardly from the respective mount arm 24 and 26 as illustrated by the broken arrows in FIG. 2. Such movement of the hitch arms 58 retracts the second portion 86 of the pin 80 from the aperture 118 of the plate 108 thus freeing the snowplow assembly 10 from the vehicle 12. It should be noted, in this unlocked position, the pin 80 remains partially housed in the bore.

The locking mechanism 126 also serves as a fail safe. If the hitch pin 80 is obstructed and cannot move into its fully engaged position, i.e. second portion 84 and tip 86 extending outwardly from the bore 40, the hitch arm 58 cannot be locked because the link arm 128 will not have entered the interior of the mount brace 28.

It should be noted that the locking pin 138 can be used in other locking applications on snowplow assemblies such as to releasably hold components in place such as stands and light assemblies.

As shown in FIG. 2, the hitch arms 58 extend beyond the broken outline of the vehicle 12. The plow mount 22 can therefore be secured and released from the vehicle 12 at a point remote from the vehicle 12. In this way, the user can engage or disengage the snowplow assembly 10 from the vehicle 12 without having to reach underneath the vehicle 12.

We claim:

1. A snowplow assembly for releasable attachment to a vehicle wherein said vehicle includes a locking mechanism and means defining an aperture in said locking mechanism, said snowplow assembly including a snowplow blade and comprising:

a frame;

a blade secured to said frame;

a portion of said frame spaced from said blade including means defining a bore;

a hitch member secured to said frame and having a portion located adjacent said locking mechanism and an extension along said frame in a direction away from said locking mechanism and toward said blade to be accessible from a point remote from said locking mechanism and toward said blade;

means mounting said hitch member on said frame for pivotal movement relative thereto, a hitch pin having a first end secured to said portion of said hitch member for movement with said hitch member and a second end, said pin being movably housed within said bore, said hitch pin and said bore being aligned with said aperture when said frame is engaged with said locking mechanism, whereby pivotal movement of said hitch member moves said pin within said bore between a first position wherein said second end is housed within said bore and a second position wherein said second end extends outwardly from said bore and into said aperture; and a lock to releasably maintain said pin in said second position.

2. The snowplow assembly of claim 1 wherein said pin has a cylindrical cross-section.

3. The snowplow assembly of claim 1 wherein said hitch member is pivotally secured to said frame about a vertical axis.

4. The snowplow assembly of claim 1 wherein said hitch member includes a first portion secured to said frame, a second portion connected to said first portion, said pin connected to and removable with said second portion, and a third portion connected to said first portion and providing said extension along said frame.

5. The snowplow assembly of claim 4 wherein said second portion of said hitch member has a longitudinal axis, wherein said pin has a longitudinal pin axis, and wherein when said pin is in said first position, said longitudinal axis of said second portion is generally perpendicular to said longitudinal pin axis.

6. The snowplow assembly of claim 1 and further including a vehicle mount adapted to be secured to the vehicle and including said locking mechanism, and wherein when said pin is in said second position said pin interengages with said vehicle mount.

7. The snowplow assembly of claim 4 wherein said first, second and third portions of said hitch member are oriented relative to each other in a generally Z-shaped configuration.

8. The snowplow assembly of claim 1 wherein said pin is stepped.

9. The snowplow assembly of claim 1 wherein said pin includes a tapered end portion.

10. The snowplow assembly of claim 1 wherein said frame includes an interior, wherein said hitch member includes a locking arm, wherein said lock is supported by said frame, and wherein when said pin is in said second position, said locking arm is housed within said interior of said frame and said lock is selectively engageable with said locking arm.

11. A snowplow assembly for releasable attachment to a vehicle, said snowplow assembly including a snowplow blade and comprising:

a mount member adapted to be secured to the vehicle, said mount member having therein an aperture;

a frame;

a hitch member having a portion located adjacent said mount member and an extension along said frame in a direction away from said mount member and said blade, said hitch member portion being secured to said frame for movement relative thereto to said hitch member having a second portion having a longitudinal axis and having therein a slot; and a hitch pin connected to said second portion so as to extend outwardly from said second portion and so as to be moveable within said slot, said pin having a longitudinal axis;

whereby movement of said hitch member relative to said frame moves said pin in said slot between a first position wherein said pin is retracted from said aperture and a second position wherein said pin interengages with said aperture to attach said assembly to the vehicle.

12. The snowplow assembly as set forth in claim 11 and further including a locking mechanism which maintains said pin in said first position.

13. The snowplow assembly as set forth in claim 11 wherein when said pin is in said first position, said longitudinal axis of said second portion is generally perpendicular to said longitudinal pin axis.

14. The snowplow assembly as set forth in claim 11 wherein said slot is elliptical.

15. The snowplow assembly as set forth in claim 11 wherein said hitch member is pivotally secured to said frame.

16. The snowplow assembly as set forth in claim 11 and further including a lock member in selective engagement with said hitch member to retain said pin in said second position.

17. The snowplow assembly as set forth in claim 11 wherein said hitch member has a generally z-shaped configuration.

18. The snowplow assembly as set forth in claim 11 wherein said frame has therein a bore and wherein said pin is movably housed within said bore.

19. The snowplow assembly as set forth in claim 11 wherein said pin includes a tapered end portion.

20. The snowplow assembly as set forth in claim 11 wherein said pin includes a first portion having a first diameter and a second portion having a second diameter, and wherein said second diameter is smaller than said first diameter.

21. The snowplow assembly as set forth in claim 20 wherein said pin terminates in a tapered end.

22. The snowplow assembly as set forth in claim 21 wherein said tapered end interengages with said aperture when said pin is in said second position.

23. The snowplow assembly as set forth in claim 11 wherein said mount member includes a first plate having therein said aperture and a second plate having therein a semi-circular recess adapted to abut said pin.

24. The snowplow assembly as set forth in claim 23 wherein said first portion is larger than said second portion.

25. The snowplow assembly as set forth in claim 23 wherein one of said first and second plates includes a flared guide portion.

26. The snowplow assembly as set forth in claim 11 wherein said pin has a cylindrical cross-section, wherein said first portion has a first diameter, wherein said second portion has a second diameter, and wherein said first diameter is larger than said second diameter.

27. The snowplow assembly as set forth in claim 11 wherein said second portion of said pin terminates in a tapered end.

28. The snowplow assembly as set forth in claim 11 wherein said pin is secured to said hitch member with a clevis.

29. The snowplow assembly as set forth in claim 11 wherein said pin has a first end that is secured to said hitch member and terminates in a second end, said first portion of said pin is adjacent said first end, said second portion of said pin extends between said first portion and said second end.

30. The snowplow assembly as set forth in claim 29 wherein said second end is tapered.

31. A snowplow assembly for connection to a vehicle comprising:

a mount member adapted to be secured to the vehicle, said mount member having a pair of relatively spaced apertures, a frame attachable to said mount member and extending away from said vehicle and aid mount member, portions of said frame spaced from said blade including means defining a pair of spaced bores, first and second hitch members secured in spaced relation on said frame;

each of said hitch members having a portion located adjacent said mount member and an extension along said frame in a direction away from said mount member and toward said blade to be accessible from a point remote from said mount member, means mounting said hitch members on said frame for pivotal movement relative thereto, a pair of hitch pins each having a first end secured to a portion of each of said hitch members and a second end, each of said pins being movably housed within a respective one of said bores, said hitch pins and said bores being aligned with a respective one of said apertures when said frame is engaged with said mount member, and whereby pivotal movement of said hitch members moves each pin within a respective one of said bores between a first position wherein said second end is housed within said bore and a second position wherein said second end extends outwardly from said bore and into a respective one of said apertures.

32. The snowplow assembly of claim 31 wherein said pin has a cylindrical cross-section.

33. The snowplow assembly of claim 31 wherein said hitch member is pivotally secured to said frame about a vertical axis.

34. The snowplow assembly of claim 31 wherein said hitch member includes a first portion secured to said frame, a second portion connected to said first portion, said second portion movably secured to said pin, and a third portion connected to said first portion.

35. The snowplow assembly of claim 34 wherein said second portion of said hitch member having a longitudinal axis, wherein said pin having a longitudinal pin axis, and wherein when said pin is in said first position, said longitudinal axis of said second portion is generally perpendicular to said longitudinal pin axis.

36. The snowplow assembly of claim 31 and further including a vehicle mount adapted to be secured to the vehicle, and wherein when said pin is in said second position, said pin interengages with said vehicle mount.

37. The snowplow assembly of claim 34 wherein said first, second and third portions of said hitch member are oriented relative to each other in a generally Z-shaped configuration.

38. The snowplow assembly of claim 34 wherein said third portion of said hitch member is adapted to project outwardly from the vehicle.

39. The snowplow assembly of claim 31 wherein said pin includes a tapered end portion.

40. The snowplow assembly of claim 31 wherein said frame includes an interior, wherein said hitch member includes a locking arm, wherein said lock is supported by said frame, and wherein when said pin is in said second position, said locking arm is housed within said interior of said frame and said lock is selectively engageable with said locking arm.

41. The snowplow assembly of claim 31 wherein said pin is stepped.

42. A snowplow assembly for releasable attachment to a vehicle, said snowplow assembly comprising:

a mount member adapted to be secured to the vehicle, said mount member having therein an aperture;

a frame;

a hitch member having a first portion movably secured to said frame and having a second portion having a longitudinal axis and having therein a slot; and a hitch pin connected to said second portion so as to extend outwardly from said second portion and so as to be moveable within said slot, said pin having a longitudinal axis;

whereby movement of said hitch member moves said pin in said slot between a first position wherein said pin is retracted from said aperture and a second position wherein said pin interengages with said aperture to attach said assembly to the vehicle.

43. The snowplow assembly of claim 42 including a lock to releasably maintain said pin in said second position.

44. A snowplow assembly for releasable attachment to a vehicle, said snowplow assembly including a snow plow blade and comprising:

a mount member adapted to be secured to the vehicle, said mount member having a pair of relatively spaced apertures, a frame attachable to said mount member and extending away from said vehicle and aid mount member, portions of said frame spaced from said blade including means defining a pair of spaced bores, first and second hitch members secured in spaced relation on said frame;

each of said hitch members having a portion located adjacent said mount member and an extension along said frame in a direction away from said mount member and toward said blade to be accessible from a point remote from said mount member, each of said hitch members having a second portion having a longitudinal axis and each of said second portions having therein a slot;

means mounting said hitch members on said frame for pivotal movement relative thereto, a pair of hitch pins each having a first end secured to one of said second portions of each of said hitch members and a second end and so as to be movable within said slot, each of said pins having a longitudinal axis and being movably housed within a respective one of said bores, said hitch pins and said bores being aligned with a respective one of said apertures when said frame is engaged with said mount member, and whereby pivotal movement of said hitch members moves each pin within a respective one of said bores between a first position wherein said second end is housed within said bore retracted from the aperture it is aligned with and a second position wherein said second end extends outwardly from said bore and into a engagement in a respective one of said apertures to attach said assembly to the vehicle.

45. The snowplow assembly as set forth in claim 44 wherein when said pin is in said first position, said longitudinal axis of said second portion is generally perpendicular to said longitudinal pin axis.

46. The snowplow assembly as set forth in claim 44 wherein said slot is elliptical.

47. The snowplow assembly as set forth in claim 44 wherein said hitch member is pivotally secured to said frame.

48. The snowplow assembly as set forth in claim 44 and further including a lock member in selective engagement with said hitch member to retain said pin in said second position.

49. The snowplow assembly as set forth in claim 44 wherein said hitch member has a generally z-shaped configuration.

50. The snowplow assembly as set forth in claim 44 wherein said frame has therein a bore and wherein said pin is movably housed within said bore.

51. The snowplow assembly as set forth in claim 44 wherein said pin includes a tapered end portion.

52. The snowplow assembly as set forth in claim 44 wherein said pin includes a first portion having a first diameter and a second portion having a second diameter, and wherein said second diameter is smaller than said first diameter.

53. The snowplow assembly as set forth in claim 52 wherein said pin terminates in a tapered end.

54. The snowplow assembly as set forth in claim 53 wherein said tapered end interengages with said aperture when said pin is in said second position.

* * * * *